US006668800B2

(12) United States Patent
Ricco et al.

(10) Patent No.: US 6,668,800 B2
(45) Date of Patent: Dec. 30, 2003

(54) INTERNAL COMBUSTION ENGINE FUEL INJECTION SYSTEM

(75) Inventors: Mario Ricco, Casamassima (IT); Alfonso Di Meo, Trani (IT); Silvio Canale, Val Della Torre (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 20 days.

(21) Appl. No.: 10/034,629

(22) Filed: Dec. 28, 2001

(65) Prior Publication Data

US 2002/0096145 A1 Jul. 25, 2002

(30) Foreign Application Priority Data

Dec. 29, 2000 (IT) ..... TO2000A1228

(51) Int. Cl.[7] ..... F02M 37/04
(52) U.S. Cl. ..... 123/446
(58) Field of Search ..... 123/506, 510–11, 123/498, 446, 457, 508, 500–501

(56) References Cited

U.S. PATENT DOCUMENTS

| | | | | |
|---|---|---|---|---|
| 4,838,232 A | | 6/1989 | Wich | 123/506 |
| 5,560,549 A | | 10/1996 | Ricco et al. | 239/533.8 |
| 5,697,343 A | | 12/1997 | Isozumi et al. | 123/446 |
| 5,711,279 A | | 1/1998 | Green et al. | 123/506 |
| 5,911,208 A | | 6/1999 | Furusawa et al. | 123/506 |
| 6,024,064 A | | 2/2000 | Kato et al. | 123/179.17 |
| 6,131,829 A | | 10/2000 | Ricco | 239/585.1 |
| 6,135,090 A | | 10/2000 | Kawachi et al. | 123/446 |
| 6,192,856 B1 | | 2/2001 | Shioi et al. | 123/300 |
| 6,192,864 B1 | | 2/2001 | Nishimura | 123/458 |
| 6,343,588 B1 | * | 2/2002 | Onishi et al. | 123/506 |
| 6,408,824 B1 | | 6/2002 | Pacucci et al. | 123/467 |
| 6,510,843 B2 | | 1/2003 | De Matthaeis | 123/506 |
| 6,546,918 B2 | | 4/2003 | Onishi et al. | 123/506 |

FOREIGN PATENT DOCUMENTS

| | | |
|---|---|---|
| DE | 19706099 | 8/1997 |
| DE | 19956267 | 5/2000 |
| DE | 19958249 | 11/2000 |
| EP | 0849438 | 6/1998 |
| EP | 0898074 | 2/1999 |

OTHER PUBLICATIONS

English Abstract of DE 19706099 Dated Aug. 21, 1997.
English Abstract of DE 19956267 Dated May 31, 2000.
English abstract of DE 19958249 dated Nov. 2, 2000.

* cited by examiner

*Primary Examiner*—Thomas N. Moulis
(74) *Attorney, Agent, or Firm*—Ladas & Parry

(57) ABSTRACT

The system has a high-pressure pump having a number of mechanical pumping elements for pumping high-pressure fuel to a common rail; and a number of injectors communicating with the rail and activated to inject a quantity of fuel sequentially into the corresponding cylinders of the engine. Each pumping element has a delivery at least equal to the maximum draw of each injector, and is activated in phase with at least one of the injectors to minimize the variations in fuel pressure in the rail. Each pumping element may be activated by a cam, which may even have a segmented profile to effect a portion of the travel of the respective pumping element in phase with a corresponding injector.

10 Claims, 3 Drawing Sheets

INTERNAL COMBUSTION ENGINE FUEL INJECTION SYSTEM

The present invention relates to a fuel injection system of an internal combustion engine having at least one cylinder cooperating with a piston activated to rotate a drive shaft. More specifically, the invention relates to an injection system comprising a pump having at least one pumping element activated to pump high-pressure fuel; a rail for the fuel so pumped; and an injector for injecting a given quantity of fuel from the rail into the engine cylinder.

BACKGROUND OF THE INVENTION

In old diesel engines, the injectors are supplied directly by a high-pressure fuel pump, the delivery of which is temporarily discontinuous, timed with the engine, and cyclically constant, i.e. a pump activated in synchronism with the injectors. This type of operation poses problems in adapting delivery of the pump to draw by the injectors, in the event of sharp variations in engine speed or load.

In modern internal combustion injection engines, each injector draws high-pressure fuel from a so-called "common rail", which forms a fuel reserve for the injectors and is normally supplied by a high-pressure piston pump in turn supplied with fuel from the fuel tank by a low-pressure pump.

In modern engines, the high-pressure pump of known injection systems has a temporarily continuous delivery not timed with the engine, i.e. is activated, for example, by a cam and therefore supplies fuel substantially continuously to the common rail, whereas the injectors are activated at a predetermined stage in the engine cylinder cycle. The fuel pressure in the common rail is controlled by a pressure regulator, but, to cater to large withdrawals of fuel, the common rail must be of considerable volume and, therefore, size. The pump must also be sized to cater to maximum fuel withdrawal by the injectors as a whole during the engine cycle, so that the volumetric efficiency of the pump is relatively poor.

Known common-rail injection systems therefore cannot be fitted to old engines with injectors supplied directly by the high-pressure pump, on account of the bulk of the injection system, and the temporarily discontinuous delivery of the high-pressure pump, which is therefore unsuitable for common-rail injection systems.

Moreover, the pressure regulator of known common-rail injection systems normally comprises a valve controlled by an electromagnet and located between the high-pressure pump and the common rail. When the valve is closed, the fuel pumped by the high-pressure pump is fed to the rail; and, when the valve is opened partly or fully, the surplus fuel pumped is drained along a drain conduit back into the tank.

In known technology, the pressure regulating valve is closed by the electromagnet when this is energized, and is kept open by a spring when the electromagnet is deenergized, so that the electromagnet is energized by a high current to open the valve partly to regulate the fuel pressure. Moreover, if the electromagnet fails to be energized during operation of the engine, the valve is opened fully by the spring, thus draining the common rail completely and arresting the engine.

SUMMARY OF THE INVENTION

It is an object of the present invention to provide an internal combustion engine fuel injection system, which provides for a high degree of reliability, is cheap to produce, and eliminates the aforementioned drawbacks typically associated with known injection systems.

According to the present invention, there is provided a fuel injection system for an internal combustion engine having at least one cylinder cooperating with a piston activated to rotate a drive shaft; said system comprising a pump having at least one pumping element activated intermittently to pump high-pressure fuel; a fuel rail communicating with a delivery conduit of said pump and for receiving the fuel so pumped; and at least one fuel injector communicating with said rail and activated to draw a given quantity of fuel from said rail and inject it into said cylinder; and said quantity varying according to the instantaneous load of said engine; characterized in that said pumping element has a delivery at least equal to the maximum draw of said injector; and said pumping element being activated in pumping phase with said injector to minimize the variations in fuel pressure in said rail.

More specifically, in the case of an internal combustion engine having a number of cylinders associated with a corresponding number of injectors communicating with the rail, the pumping element has a delivery at least equal to the maximum draw of each of said injectors, and is activated in pumping phase with a corresponding injector in said number.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
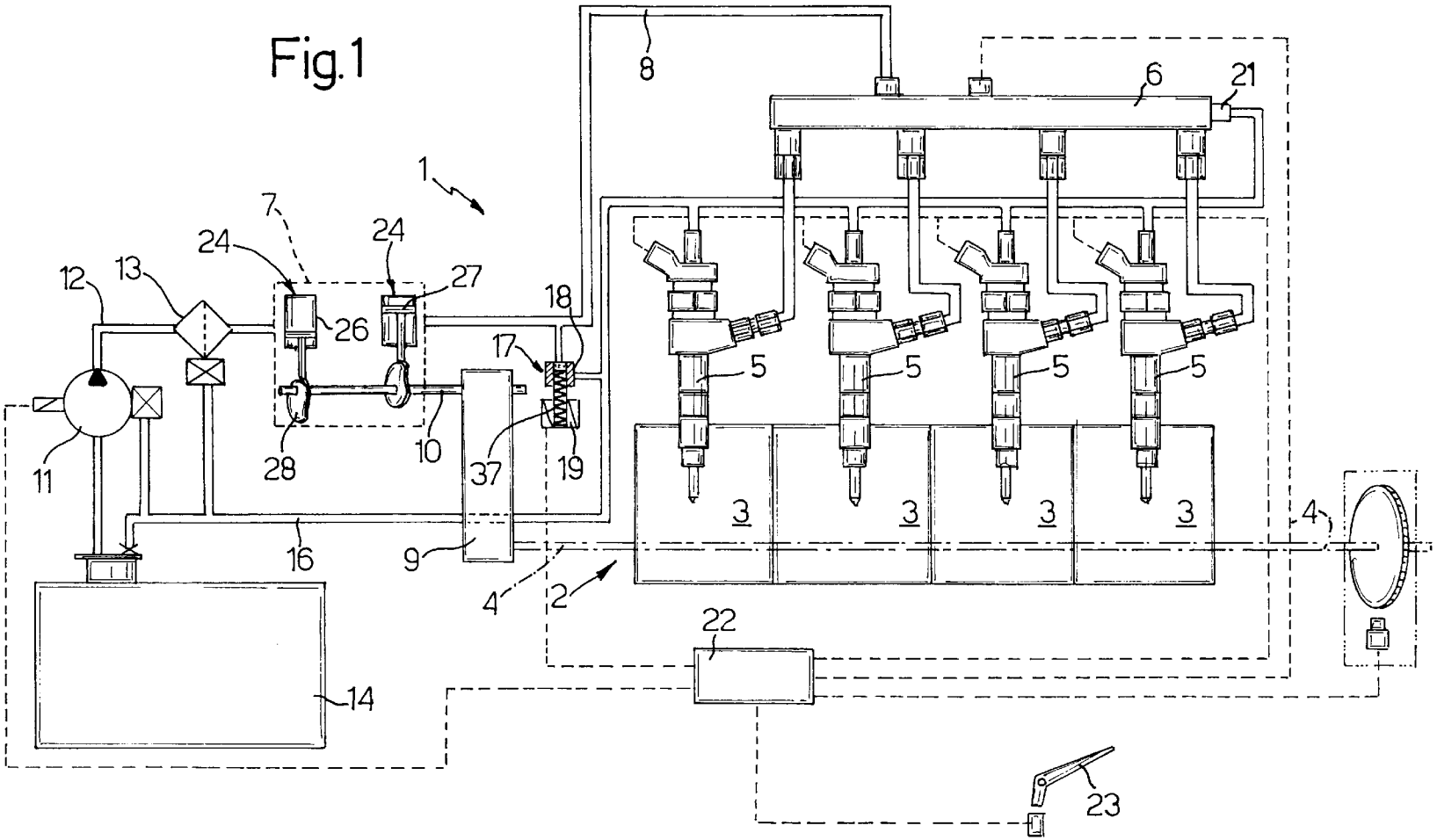
FIG. 1 shows a diagram of an internal combustion engine common-rail fuel injection system in accordance with the invention.

Number 1 in FIG. 1 indicates as a whole a common-rail fuel injection system of an internal combustion, e.g. diesel, engine 2 comprising a number of, e.g. four, cylinders 3 cooperating with corresponding pistons (not shown) activated to rotate a drive shaft 4 indicated by the dot-and-dash line in FIG. 1. Drive shaft 4 is connected by a transmission device 9 to a conventional camshaft 10 controlling the intake and exhaust valves of cylinders 3.

Injection system 1 comprises a number of electromagnetic injectors 5 associated with and for injecting high-pressure fuel into cylinders 3.

Injectors 5 are connected to a common header or so-called common rail 6, which is supplied with high-pressure fuel along a high-pressure delivery conduit 8 by a mechanical high-pressure pump 7.

High-pressure pump 7 is in turn supplied by a low-pressure, e.g. motor-driven, pump 11. A low-pressure delivery conduit 12 and a fuel filter 13 are located between motor-driven pump 11 and pump 7. And motor-driven pump 11 is normally housed in the fuel tank 14, in which a drain conduit 16 terminates to drain off the surplus fuel from motor-driven pump 11 and filter 13.

A pressure regulating device 17, for regulating the pressure in conduit 8, is located between delivery conduit 8 of high-pressure pump 7 and drain conduit 16, and comprises a solenoid valve defined by a valve 18 controlled by an electromagnet 19. Valve 18 provides for feeding any surplus fuel into drain conduit 16 to maintain the required pressure in common rail 6. Conduit 16 also feeds into tank 14 the drain fuel of injectors 5 and, via a pressure-limiting valve 21, any surplus fuel accumulated in common rail 6.

The fuel in tank 14 is at atmospheric pressure. In actual use, motor-driven pump 11 compresses the fuel to a low pressure, e.g. of about 2–3 bars; high-pressure pump 7 compresses the incoming fuel from conduit 12 to feed the fuel along conduit 8 to common rail 6 at a high pressure, e.g. of about 1500 bars; and each injector 5 injects into respective cylinder 3 a quantity of fuel ranging between a minimum and maximum value, under the control of an electronic control unit 22, which may be defined by the usual central microprocessor control unit controlling engine 2.

Control unit 22 receives signals indicating the operating conditions of engine 2—such as the position of accelerator pedal 23, the number of revolutions of drive shaft 4, and the fuel pressure in common rail 6, which are detected by corresponding sensors—and, by processing the incoming signals according to a given program, controls the instant and for how long individual injectors 5 are operated, as well as the flow of low-pressure motor-driven pump 11.

Figure 2:
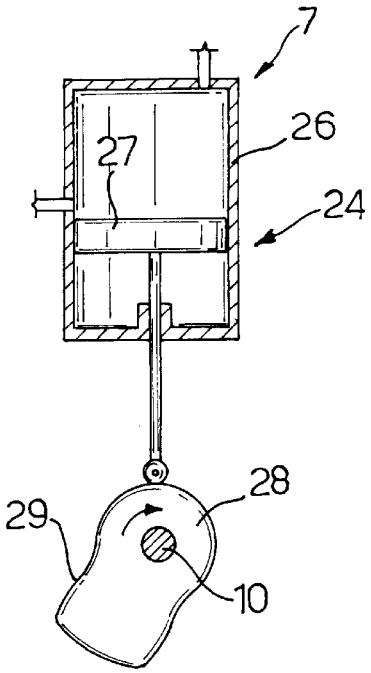
FIG. 2 shows a schematic section of a first variation of a high-pressure pump for the FIG. 1 injection system.

According to the invention, control unit 22 controls device 17 self-adaptively, so as to premeter the fuel supplied along conduit 8 to common rail 6. High-pressure pump 7 comprises one or more pumping elements 24, each having a cylinder 26 and a piston 27, which is activated by a corresponding cam 28, 30 (see FIGS. 2 and 3). Cams 28, 30 are carried by a drive shaft of pump 7, which is preferably defined by an engine shaft provided for other functions. For example, the drive shaft of pump 7 may be defined by shaft 10 operating the intake and exhaust valves of cylinders 3, or by drive shaft 4 itself.

Each pumping element 24 of pump 7 has a constant delivery at least equal to the maximum draw of each injector 5; and each cam 28, 30 is shaped to activate the corresponding pumping element 24 in synchronism, i.e. in pumping phase, with the corresponding injector 5, so as to minimize the variation in fuel pressure in common rail 6.

Since the fuel draw time of injectors 5 is variable, the synchronism or pumping phase of piston 27 and the corresponding injector 5 is intended in the sense that the stroke, controlled by cam 28, 30, of piston 27 is performed within the operating phase of the corresponding cylinder 3 of engine 2 into which fuel is injected. Advantageously, the lifts of cam 28, 30 are designed to activate pumping element 24 with a phase of −50° to +20° (engine angle) with respect to the top dead center position at the compression stroke of the corresponding cylinder 3 of engine 2 into which fuel is injected by the corresponding injector 5.

Device 17 premeters the fuel so that the amount of fuel supplied to conduit 8 by each pumping element 24 equals the sum of the amount of fuel to be injected by the corresponding injector 5, the amount of fuel required to operate injector 5, and any leakage, which varies according to the wear of injector 5. Any surplus fuel pumped by the activated pumping element 24 is drained by device 17 into conduit 16.

This therefore ensures that, following fuel injection into each cylinder 3 of engine 2, common rail 6 is supplied with substantially the amount of fuel drawn by the corresponding injector 5, so that, when fuel is next drawn, the fuel pressure has been restored. The volume of common rail 6 may therefore be minimized, so that injection system 1 is compact and cheap to produce, and can be designed for retrofitting, even on existing direct-injection engines, i.e. with no common rail 6.

In a first variation of pump 7 for injection system 1, each piston 27 of pump 7 is activated by a cam 28 (FIG. 2) having a lift 29 for performing a full stroke of piston 27. In which case, each pumping element 24 is activated each time in pumping phase with an injector 5 of engine 2 (FIG. 1). Pump 7 may have a number of pumping elements 24 equal to the number of injectors 5, in which case, cams 28 are timed on shaft 10 so that each pumping element 24 is activated in pumping phase with the corresponding injector 5.

Alternatively, pump 7 may have a number of pumping elements 24 equal to a submultiple of the number of injectors 5, or even only one pumping element 24. Transmission device 9 and/or the profile of cam 28 are therefore selected to activate each pumping element 24 in pumping phase with more than one injector 5 or even all of injectors 5.

In a further variation of high-pressure pump 7, each pumping element 24 is activated by a cam 30 (FIG. 3) with a segmented profile, so as to control the stroke of the corresponding piston 27 in two or more portions. Transmission device 9 and/or the profile of cam 30 are therefore selected so that each cam 30 moves piston 27 through a portion of its stroke in pumping phase with a corresponding injector 5.

Figure 3:
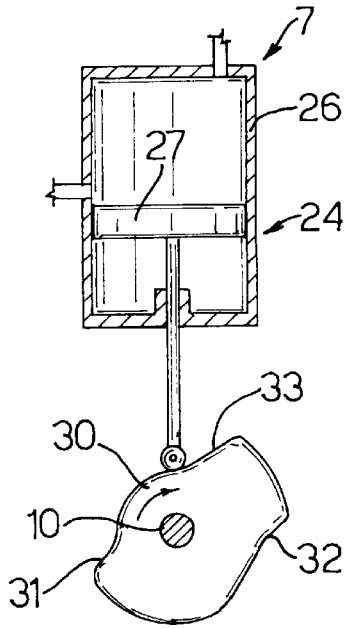
FIG. 3 shows a schematic section of a further variation of the high-pressure pump for the FIG. 1 injection system.

More specifically, for the engine 2 with four cylinders 3 in FIG. 1, the FIG. 3 pump 7 may have two pumping elements 24, and cam 30 of each piston 27 has a lift comprising two successive up or compression steps 31 and 32, and only one down or intake step 33. Each step 31 and 32 moves relative piston 27 through a corresponding portion of the compression stroke, while down step 33 controls a single intake stroke.

Figure 4:
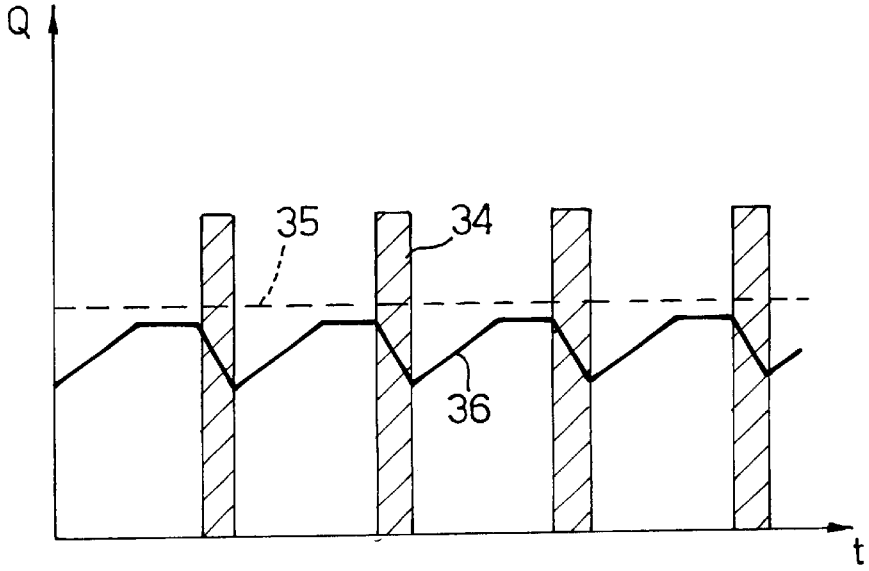
FIG. 4 shows an operating graph of the injection system according to the invention.

The bar graph 34 in FIG. 4 shows intermittent fuel draw from rail 6 made successively by injectors 5 of engine 2. The dash line 35 shows the maximum pressure, controlled by valve 21, of the fuel in rail 6, and the continuous line 36 the actual fuel pressure in rail 6. As shown clearly by line 36, by virtue of being pumped in phase by pumping elements 24 of pump 7, the fuel in rail 6 undergoes very little variation, which limited to the interval between one draw and the next by injectors 5, and is therefore practically negligible.

Figure 5:
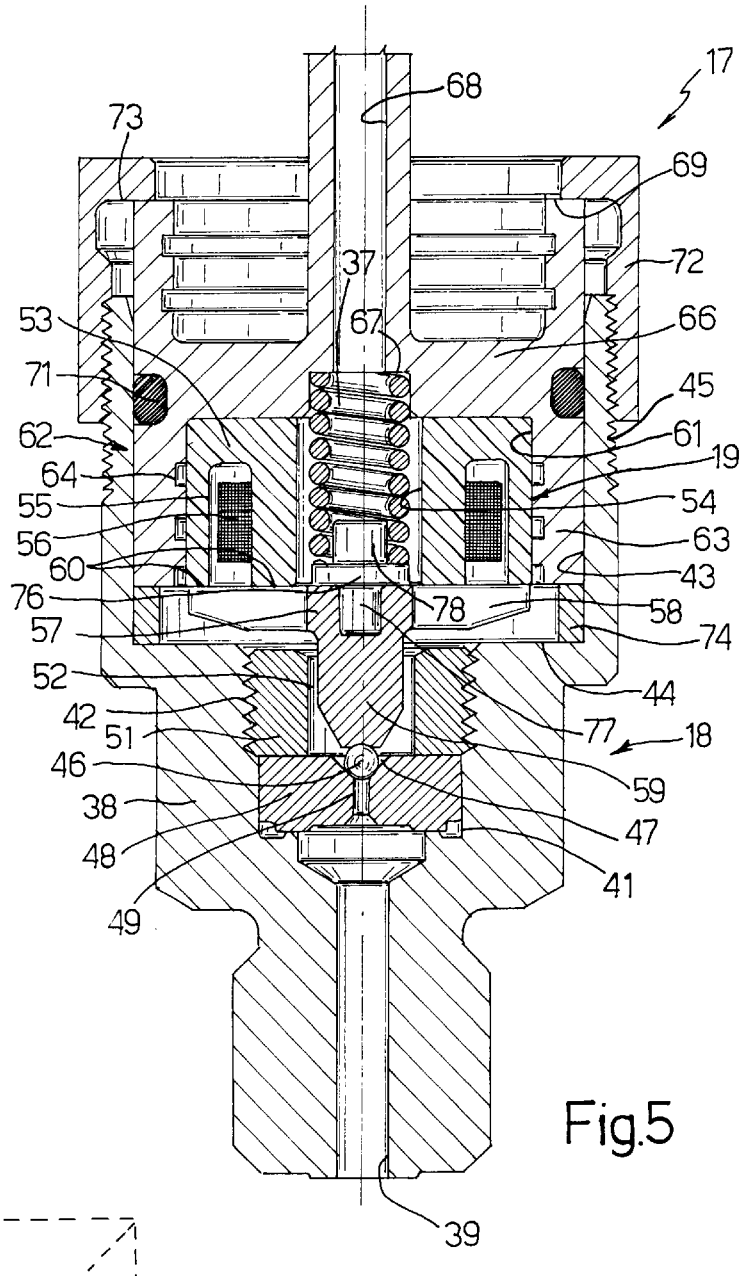
FIG. 5 shows a mid-section of a fuel premetering device for the FIG. 1 system.

Valve 18 of premetering device 17 is normally closed by elastic means, e.g. a spring 37 (FIG. 1), and electromagnet 19 is energized to open valve 18 in opposition to spring 37. In a preferred embodiment, valve 18 comprises a hollow, substantially cylindrical valve body 38 (FIG. 5) having an axial conduit 39 connectable, in use, to high-pressure conduit 8 (FIG. 1), and a first cylindrical cavity 41 communicating and coaxial with conduit 39. The lateral wall of cavity 41 has an internally threaded portion 42; valve body 38 also has a coaxial second cylindrical cavity 43 forming an annular shoulder 44 with cavity 41; and the lateral wall of cavity 43 has an externally threaded portion 45.

Valve 18 also comprises a shutter defined by a ball 46, which cooperates with a truncated-cone-shaped seat 47 of a cylindrical member 48 having a central hole 49. Member 48 is housed inside cavity 41, so that seat 47 communicates with axial conduit 39, and is fixed inside cavity 41 by a threaded inner ring nut 51 having a prismatic hole 52 engaged by an Allen wrench.

Electromagnet 19 comprises a cylindrical core 53 made of magnetic material and which has a central hole 54, and an annular cavity 55 housing the solenoid 56 of electromagnet 19. Solenoid 56 activates an armature 57 made of ferromagnetic material and in the form of a disk with radial slits 58. Armature 57 has an axial appendix or stem 59 housed in hole 52 and for engaging ball 46. The surface of armature 57 on the opposite side to stem 59 is flat and cooperates with two polar surfaces 60 of core 53.

Core 53 is forced inside a cylindrical cavity 61 of a cup-shaped body 62 comprising a lateral wall 63 with two annular grooves 64; an end wall 66 with an axial depression 67; an axial conduit 68 connected, in use, to drain conduit 16 of injection system 1; and an annular edge 69 on the opposite side to lateral wall 63.

Cup-shaped body 62 is housed inside cavity 41 of valve body 38 with the interposition of a high-pressure fuel seal 71, and is fixed inside cavity 41 of valve body 38 by a threaded outer ring nut 72 having a shoulder 73 engaging edge 69 of cup-shaped body 62. A calibrated shim 74 is interposed between shoulder 44 of valve body 38 and cup-shaped body 62, and defines the axial travel of armature 57.

Spring 37 of valve 18 is a helical compression spring, and is located between depression 67 in end wall 66 and a flange 76. Flange 76 has a pin 77 inserted inside an axial depression in armature 57; and a further pin 78 for guiding spring 37. Spring 37 is calibrated to keep ball 46 in the closed position until the fuel pressure in conduit 39 reaches the maximum operating value of injection system 1.

The component parts of valve 18 are assembled inside valve body 38 by first inserting cylindrical member 48 inside cavity 41. Inserting an Allen wrench inside hole 52, inner ring nut 51 is then screwed inside threaded portion 42 to fix member 48 firmly inside cavity 41 of valve body 38. On one side, ball 46 and stem 59 of armature 57 are then inserted inside hole 52 in member 48, and, on the other side, core 53 and solenoid 56 are inserted inside cup-shaped body 62.

Flange 76 and spring 37 are then inserted inside hole 54 in core 53; shim 74 is inserted inside cavity 41 of valve body 38; cup-shaped body 62 with seal 71 is inserted inside cavity 41; and outer ring nut 72 is screwed on to threaded portion 45, so that the edge of lateral wall 63 rests on shim 74, and cup-shaped body 62 is fixed firmly inside cavity 41 of valve body 38.

Self-adaptive premetering device 17 operates as follows.

Spring 37 normally keeps ball 46 in the closed position, so that none of the high-pressure fuel in conduit 39 passes through valve 18, and all the high-pressure fuel is fed along conduit 8 to common rail 6. When the pressure of the fuel in conduit 39 exceeds the set maximum, e.g. in the event of a fault on valve 21, the fuel pressure overcomes spring 37 to move ball 46 into the open position, so that the surplus fuel is drained into tank 14 via hole 49 in member 48, hole 52 in ring nut 51, slits 58 in armature 57, hole 54 in core 53, conduit 68 in cup-shaped body 62, and drain conduit 16.

When the operating conditions of engine 2 call for a lower fuel pressure than the maximum to which spring 37 is set, control unit 22 operates valve 18 to premeter fuel supply to rail 6 self-adaptively. That is, depending on the operating conditions of engine 2, unit 22 simultaneously emits a control signal for controlling the individual injector 5, and a control signal for controlling valve 18 and which energizes solenoid 56 of electromagnet 19 with a corresponding electric current I.

Electromagnet 19 therefore attracts armature 57 with a force in opposition to that of spring 37 to move ball 46 into a corresponding open position, so that the amount of fuel supplied to common rail 6 at each operation of a pumping element 24 substantially equals the amount of fuel drawn by the corresponding injector 5 at the same phase, and which equals the sum of the amount of fuel injected into cylinder 3, the amount of fuel used to operate injector 5, and the amount of fuel leaking through the joints of the various conduits of injector 5.

As is known, the most frequent variations in the flow of valve 18 are those close to the flow corresponding to the setting of spring 37, i.e. to the set maximum fuel pressure in rail 6, while variations in fuel flow at a fuel pressure close to drain pressure are more or less rare or useless. The excitation current of electromagnet 19 advantageously varies between zero, when ball 46 is to be kept in the closed position by spring 37, and a maximum value Imax, when valve 18 is to be opened fully. More specifically, electromagnet 19 is energized by a current I inversely proportional to the required pressure P in conduit 8, as shown by the continuous line in the FIG. 6 graph. Current I therefore varies between zero, to allow spring 37 to keep valve 18 fully closed so that the fuel pressure in conduit 8 is maximum, and a predetermined maximum value Imax to open valve 18 fully and reduce the fuel pressure to the atmospheric pressure in tank 14.

Figure 6:
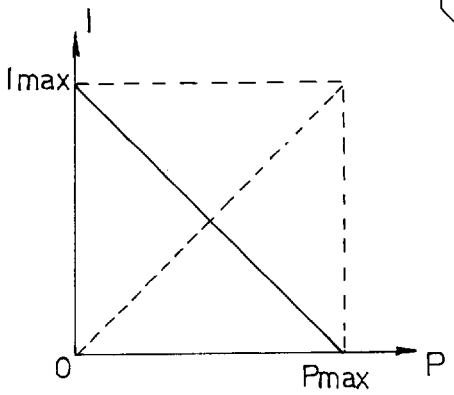
FIG. 6 shows an operating graph of the FIG. 5 premetering device.

The above control strategy of device 17 is the reverse of known pressure regulators, in which the regulating valve is closed when the electromagnet is energized, and in which the fuel pressure in conduit 8, in fact, is substantially inversely proportional to the excitation current I of the electromagnet, as shown by the dash line in FIG. 6. The reverse control strategy is particularly useful, since a small-volume rail 6 is subject to frequent microvariations in pressure, which can be corrected by energizing electromagnet 19 with a very low current.

The advantages, with respect to known injection systems, of the fuel injection systems according to the invention will be clear from the foregoing description. In particular, the volume of common rail 6 can be reduced, thus reducing the cost of the injection system; the flow of pump 7 may also be lower than that required by known technology; and the injection system may be retrofitted to any known injection engine.

Moreover, in the event electromagnet 19 fails to be energized, premetering device 17 ensures against any pressure drop in or fuel drainage from the common rail, so that the engine continues operating. Since variations in flow at pressures close to the setting of spring 37 are obtained with a very low current, operation of premetering device 17 is more reliable. And finally, since a low current is sufficient to control considerable forces generated by the high fuel pressure, and with respect to which the inertia and/or friction of ball 46 and armature 57 are negligible, the flow of valve 18 can be controlled extremely accurately.

Clearly, further changes can be made to the injection system as described herein without, however, departing from the scope of the accompanying Claims. For example, engine 2 may have only one cylinder 3; pump 7 may have a number of pumping elements 24 other than that indicated; cams 38 may have a segmented profile with more than two lifts; and/or more than one injector 5 may be provided for each cylinder 3.

Pump 7 may be activated by a dedicated shaft, as opposed to a shaft provided for other engine functions; and the dedicated shaft may be activated by the drive shaft via a gear transmission or belt and toothed pulley transmission, or even by a respective electric motor operated in time with drive shaft 4 by control unit 22.

Valve 18 may also be used as a pressure regulator in known common-rail injection systems. And spring 37 in FIG. 5 may be replaced by a Belleville washer or leaf spring, and ball 46 by a plate.

What is claimed is:

1. A fuel injection system for an internal combustion engine having at least one cylinder (3) cooperating with a piston activated to rotate a drive shaft (4); said system comprising a pump (7) having at least one pumping element (24) activated to pump high-pressure fuel; a fuel rail (6) communicating with a delivery conduit (8) of said pump (7) and for receiving the fuel so pumped; and an injector (5) communicating with said rail (6) and activated to draw a given quantity of fuel from said rail (6) and inject said quantity of fuel into said cylinder (3); said quantity varying according to instantaneous load of said engine (2); said pumping element (24) having a delivery at least equal to the maximum draw of said injector (5); said pumping element (24) being activated in pumping phase with said injector (5) to deliver said quantity of fuel to said rail before and after a top dead center position of a compression stroke of the piston in the cylinder (3) to minimize variations in fuel pressure in said rail (6).

2. An injection system as claimed in claim 1, wherein the internal combustion engine (2) has a number of cylinders (3) associated with a corresponding number of injectors (5) communicating with said rail (6).

3. An injection system as claimed in claim 2, wherein said pumping element (24) is activated by a cam (28, 30) carried by a shaft (4, 10) provided for other functions of said engine (2).

4. An injection system as claimed in claim 3, wherein said cam (28, 30) comprises a lift (29, 31, 32) to activate the pumping element (24) to deliver the fuel to the rail in a phase of −50° to +20° with respect to top dead center position of the compression stroke of the piston in the cylinder (3).

5. An injection system as claimed in claim 3, wherein said pumping element (24) is activated by a segmented-profile cam (30) to control only a portion of the travel of said pumping element (24) in phase with one of said injectors (5).

6. An injection system as claimed in claim 5, wherein said pump (7) comprises a number of pumping elements (24) equal to a submultiple of the number of said cylinders (3); each segmented-profile cam (30) having a group of lift steps (31, 32) to control a corresponding group of successive portions of said travel.

7. A fuel injection system for an internal combustion engine having a plurality of cylinders (3) cooperating with respective pistons activated to rotate a drive shaft (4); said system comprising a pump (7) having at least one pumping element (24) for every two of said cylinders (3) to pump high-pressure fuel for delivery to said cylinders (3); a fuel rail (6) communicating with a delivery conduit (8) of said pump (7) and for receiving the fuel so pumped; an injector (5) communicating with each respective cylinder and with said rail (6) and activated to draw a given quantity of fuel from said rail (6) and inject said quantity into the respective cylinder (3); said quantity varying according to instantaneous load of said engine (2); said at least one pumping element (24) having a delivery at least equal to a maximum draw of the injectors (5) in the two respective cylinders; said at least one pumping element (24) being activated in pumping phase with said injectors (5) to minimize variations in fuel pressure in said rail (6); said at least one pumping element (24) being activated by a segmented profile cam carried by a shaft (4, 10) driven by the engine; said at least one pumping element (24) for every two of said cylinders (3) being activated in phase with two of said injectors (5) associated with said two cylinders; and said segmented-profile cam (30) having a profile defined by two lift steps (31, 32).

8. An injection system as claimed in claim 1, comprising a premetering device (17) for premetering fuel flow to said rail (6); wherein said premetering device (17) comprises a valve (18) normally closed by elastic means (37); said valve (18) being controlled by an electromagnet (19) which is energized to open said valve (18) in opposition to elastic means (37).

9. An injection system as claimed in claim 4 wherein said cam (28, 30) has an irregular shape with a dwell portion and said lift (29, 31, 32), said dwell portion extending over a larger extent of the cam (28, 30) than said lift (29, 31, 32).

10. As injection system as claimed in claim 7 wherein said segmented profile cam (30) has two said lift steps (31, 32) and one intake step (33) so that said cam (30) provides two strokes of the pumping element (24) for supplying fuel to the rail (6) in phase with the injectors of said two cylinders (3) of said engine (2).

* * * * *